US009016888B2

(12) United States Patent
Glynn et al.

(10) Patent No.: US 9,016,888 B2
(45) Date of Patent: Apr. 28, 2015

(54) NON COMBUSTIBLE, TACTICAL FLASH DEVICE

(75) Inventors: Kenneth P. Glynn, Flemington, NJ (US); Nicholas Klementowicz, III, Hillsborough, NJ (US); John A. Dapkins, Jr., Bloomsbury, NJ (US)

(73) Assignee: Jersey Tactical Corp., Lopatcong, NJ (US)

( * ) Notice: Subject to any disclaimer, the term of this patent is extended or adjusted under 35 U.S.C. 154(b) by 1043 days.

(21) Appl. No.: 12/284,274

(22) Filed: Sep. 19, 2008

(65) Prior Publication Data

US 2010/0072895 A1 Mar. 25, 2010

(51) Int. Cl.
*F41H 13/00* (2006.01)
*H05B 41/34* (2006.01)

(52) U.S. Cl.
CPC ..... *F41H 13/0087* (2013.01); *F41H 13/0081* (2013.01); *H05B 41/34* (2013.01)

(58) Field of Classification Search
CPC .. F41H 13/0081; F41H 13/0087; H05B 41/34
USPC ..... 362/208, 112, 113, 251; 315/76, 56, 58
See application file for complete search history.

(56) References Cited

U.S. PATENT DOCUMENTS

| | | | | |
|---|---|---|---|---|
| 4,141,295 | A * | 2/1979 | Campbell et al. | 102/407 |
| 4,319,426 | A | 3/1982 | Lee | |
| 4,976,201 | A | 12/1990 | Hamilton | |
| 5,246,372 | A * | 9/1993 | Campagnuolo et al. | 446/473 |
| 5,351,623 | A | 10/1994 | Kissel et al. | |
| 5,764,134 | A | 6/1998 | Carr et al. | 340/384.1 |
| 5,824,945 | A * | 10/1998 | Barlog et al. | 102/482 |
| 6,112,733 | A | 9/2000 | Wooten et al. | |
| 6,142,894 | A | 11/2000 | Lee | |
| 6,253,680 | B1 | 7/2001 | Grubelich | |
| 6,767,108 | B1 * | 7/2004 | Blachowski et al. | 362/112 |
| 7,191,708 | B2 | 3/2007 | Ouliarin | |
| 7,401,935 | B2 * | 7/2008 | VanderSchuit | 362/101 |
| 7,535,341 | B2 * | 5/2009 | Haase | 340/326 |
| 8,113,689 | B2 * | 2/2012 | Mayo et al. | 362/253 |
| 2008/0156220 | A1 * | 7/2008 | Tanguy | 102/482 |

OTHER PUBLICATIONS

A publication by Midé Technology Corporation entitled "*MIG44—Non Lethal Interference Grenade*". Product can be found at http//www.mide.com/technology/mig44.php.

* cited by examiner

*Primary Examiner* — Anh Mai
*Assistant Examiner* — Jessica M Apenteng
(74) *Attorney, Agent, or Firm* — Ernest D. Buff & Assoc. LLC; Ernest D. Buff; Harry Anagnos, Esq.

(57) ABSTRACT

A to a non-combustible, tactical flash device includes a non-spherical hollow main housing having a plurality of flat surfaces, adapted to hold internal functional components. The internal functional components include: (i.) an externally exposed activation component located on the main housing; (ii.) a power connected to the activation component and to a control chip; (iii.) the control chip also being connected to at least one speaker and at least one light source, the control chip including capabilities for delay of processing of other commands upon initiation of the activation component, and for subsequent processing of other commands including sound delivery to at least one speaker and/or light activation to at least one light source. Optionally, a beacon transmitter may also be included.

15 Claims, 9 Drawing Sheets

NON COMBUSTIBLE, TACTICAL FLASH DEVICE

BACKGROUND OF INVENTION a. Field of Invention

The invention relates generally to a flash device used by tactical and other forces that replaces conventional detonating flash-bang diversionary devices and also functions in other manners, such as an evidence locator or a marker. The device has a non-spherical shape to reduce run away rolling and to enhance accuracy in deployment. It includes a power source, controls, at least one light source and at least one sound source with speaker. It is sized to be ergonomic and easy to carry and to deploy. In some embodiments, it may be programmable to offer different sounds, lights, patterns, frequencies and periodicities. Thus, it could be programmed for a single flash and bang, a dog barking, light only, flashing beacon until battery dies, etc.

b. Description of Related Art

The following patents are representative of the field pertaining to the present invention:

U.S. Pat. No. 7,191,708 B2 to Ouliarin describes a diversion grenade comprising: a transparent body in which is located one or more charges of flash material; an internal power supply; a control circuit that is responsive to one or more inputs, the control circuit producing one or more output signals; and an external user operated trigger for initiating a user input for activating the grenade. The grenade may also include tracer lights and sound emitters.

U.S. Pat. No. 6,767,108 B1 to Blachowski et al. describes a non-lethal flash grenade includes a transparent, generally cylindrical housing; a layer of flash lamps disposed in the housing; an ignition circuit connected to a first centrally located flash lamp in the layer of flash lamps; a battery connected to the ignition circuit; and a variable time delay switch connected to the ignition circuit; whereby the first centrally located flash lamp is activated by the ignition circuit and remaining flash lamps are sympathetically activated by a flash of the first centrally located flash lamp.

U.S. Pat. No. 6,253,680 B1 to Grubelich decribes a diversionary device that has a housing having at least one opening and containing a non-explosive propellant and a quantity of fine power packed within the housing, with the powder being located between the propellant and the opening. When the propellant is activated, it has sufficient energy to propel the powder through the opening to produce a cloud of powder outside the housing. An igniter is also provided for igniting the cloud of powder to create a diversionary flash and bang, but at a low enough pressure to avoid injuring nearby people.

U.S. Pat. No. 6,142,894 to Lee describes an article suitable for throwing in games and able to produce sound and light on impact is provided. The article includes a rigid inner shell having sound and light producing apparatus mounted therein and a flexible outer layer integrally formed from clear or opaque plastic material to cover the entire inner shell and to provide the article with sufficient impact strength and safety in use. The sound and light producing apparatus is powered with batteries and preset to be actuated on impact. The inner shell and the outer layer are formed of aligned sound holes and insertion slots. When the article is not in use, an insert plate can be inserted into the aligned insertion slots to open the circuit of the sound and light producing means and thereby prevents the same from unexpected actuation and unnecessary consumption of battery energy.

U.S. Pat. No. 6,112,733 to Wooten et al. describes an intrusion apparatus for safely propelling a non-lethal diversionary device into a structure through a barrier. The intrusion apparatus comprises an extension device adapted to be gripped by an individual and being movable generally towards the barrier by the individual. A support assembly is connected to the extension device. The support assembly serves to support the non-lethal diversionary device as the extension device is moved towards the barrier. A barrier breaking assembly is also supported by the extension device. The barrier breaking assembly forms an opening sized to receive the non-lethal diversionary device through the barrier as the extension device is being moved towards the barrier. A propelling assembly is also supported by the extension device. The propelling assembly serves to selectively propel the non-lethal diversionary device into the structure through the opening formed in the barrier at a non-lethal velocity.

U.S. Pat. No. 5,351,623 to Kissel et al. describes a device which safely simulates the loud noise and bright flash of light of an explosion. This device consists of an ordinance case which encloses a battery, an electronic control module, a charging circuit board, a bridge head, and a shock tube dusted with aluminum and an explosive. The electronic control module provides a time delay between initial activation of the device and the time when the device is ready to create a shock wave. Further, this electronic control module provides a central control for the electronics in the simulator. The charging circuit board uses the battery to charge a capacitor. Passing the voltage stored in the capacitor through the wires of the bridge head cause the explosive and the aluminum in the shock tube to react. This reaction produces a loud noise and bright white flash of light which simulates and explosion.

U.S. Pat. No. 4,976,201 to Hamilton describes a distraction device comprised of a hollow container that is divided into a first chamber and a second chamber. An explosive charge capable or producing a loud sound and a brilliant flash of light fills the second chamber. A standard M201 hand grenade fuse is installed in the distraction device so that the fuse is in communication with the first chamber. The fuse initiates the sequential ignition of several combustible compositions in the distraction device. A first combustible composition generates a combustion gas of sufficient pressure in the first chamber to separate the expended fuse from the distraction device before the device explodes. The first composition also ignites a combustible time-delay composition, which in turn ignites a spark-producing composition that detonates and explosive output charge. Separation of the fuse from the distraction device before the explosive charge is detonated prevents the fuse from becoming a lethal projectile. The distraction device is distracting and temporarily disorienting a suspect or enemy.

U.S. Pat. No. 4,319,426 to Lee describes the present invention relating to one kind of toy grenade that cab be triggered a few seconds after the safety pin ring has been pulled outward so that a strikingly similar effect of an actual grenade is obtained, and it includes few component parts which ensure both its low cost of production and its durability in consecutive use.

Notwithstanding the prior art, the present invention is neither taught nor rendered obvious thereby.

SUMMARY OF INVENTION

The present invention is directed to a non-combustible, tactical flash device. It includes: (a) a non-spherical hollow main housing having a plurality of flat surfaces, the main housing having mounting means for internal functional components; and, (b) internal functional components connected to the mounting means of the main housing, including: (i.) an externally exposed activation component located on the main housing; (ii.) a power source located within the main housing and being connected to the activation component and to a control chip; (iii.) the control chip located within the main housing and being connected to the power source and connected to at least one speaker and at least one light source, the control chip including capabilities for delay of processing of other commands upon initiation of the activation component, and for subsequent processing of other commands including sound delivery to the at least one speaker and light activation to the at least one light source; (iv.) the at least one speaker located within the main housing and being functionally connected to the control chip and having sound exposure external to the main housing; and, (v.) the at least one light source located within the main housing and being functionally connected to the control chip and having light exposure external to the main housing.

In some preferred embodiments of the present invention, the main housing and the internal functional components have a total weight in excess of one pound and less than six pounds. The main housing may be smaller, but preferred sizes are in the range of 3 to 6 inch maximum dimension, i.e. the largest size cross section.

In some preferred embodiments of the present invention, the main housing and the internal functional components weight in excess of one and one-half pounds and less than four pounds.

In some preferred embodiments of the present invention, the main housing has a symmetrical shape with a plurality of flat sides.

In some preferred embodiments of the present invention, the internal functional components further includes at least one beacon transmitter.

In some preferred embodiments of the present invention, the control chip is preprogrammed to deliver at least one sound selected from the group consisting of a detonation, a dog bark, an alarm, a siren, and a human voice.

In some preferred embodiments of the present invention, the at least one light source in at least three different light sources having light beam generation in at least three different directions.

In some preferred embodiments of the present invention, the at least one speaker is at least three different speakers having sound generation in at least three different directions.

In some preferred embodiments of the present invention, the at least one light source is selected from the group consisting of lasers, LEDs, photovoltaics, flash bulbs, infrared and flashlight bulbs.

In some preferred embodiments of the present invention, the control component is preprogrammed to intermittently repeat at least one of sound delivery and light activation for predetermined time lengths and periodicities.

In some preferred embodiments of the present invention, the main housing includes component parts that permit opening for exposure to the internal functional components and subsequent secure closing thereof.

In a different preferred embodiment of the present invention, the non-combustible, tactical flash device includes: (a) a non-spherical hollow main housing having a plurality of flat surfaces, the main housing having mounting means for internal functional components; and, (b) internal functional components connected to the mounting means of the main housing, including: (i.) an externally exposed activation component located on the main housing; (ii.) a power source located within the main housing and being connected to the activation component and to a control chip; (iii.) the control chip located within the main housing and being connected to the power source and connected to at least one speaker and at least one light source, the control chip including capabilities for delay of processing of other commands upon initiation of the activation component, and for subsequent processing of other commands including sound delivery to the at least one speaker and light activation to the at least one light source; (iv.) the at least one speaker located within the main housing and being functionally connected to the control chip and having sound exposure external to the main housing; and, (v.) the at least one light source located within the main housing and being functionally connected to the control chip and having light exposure external to the main housing; (c) programmable control means located at least one of externally from and internally with the main housing, the programmable control means including means for selecting at least one device characteristic selected from the group consisting of sound choices, light choices and periodicity choices.

In some preferred embodiments of the present invention set forth in paragraph [00023] above, the main housing and the internal functional components have a total weight in excess of one pound and less than six pounds.

In some preferred embodiments of the present invention set forth in paragraph [00023] above, the main housing and the internal functional components weight in excess of one and one-half pounds and less than four pounds.

In some preferred embodiments of the present invention set forth in paragraph [00023] above, the main housing has a symmetrical shape with a plurality of flat sides.

In some preferred embodiments of the present invention set forth in paragraph [00023] above, the internal functional components further includes at least one beacon transmitter.

In some preferred embodiments of the present invention set forth in paragraph [00023] above, the control chip is preprogrammed to deliver at least one sound selected from the group consisting of a detonation, a dog bark, an alarm, a siren, and a human voice.

In some preferred embodiments of the present invention set forth in paragraph [00023] above, the at least one light source in at least three different light sources having light beam generation in at least three different directions.

In some preferred embodiments of the present invention set forth in paragraph [00023] above, the at least one speaker in at least three different speakers having sound generation in at least three different directions.

In some preferred embodiments of the present invention set forth in paragraph [00023] above, the at least one light source is selected from the group consisting of lasers, LEDs, photovoltaics, flash bulbs, infrared and flashlight bulbs.

In some preferred embodiments of the present invention set forth in paragraph [00023] above, the control component is preprogrammed to intermittently repeat at least one of sound delivery and light activation for predetermined time lengths and periodicities.

In some preferred embodiments of the present invention set forth in paragraph [00023] above, the main housing includes component parts that permit opening for exposure to the internal functional components and subsequent secure closing thereof.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
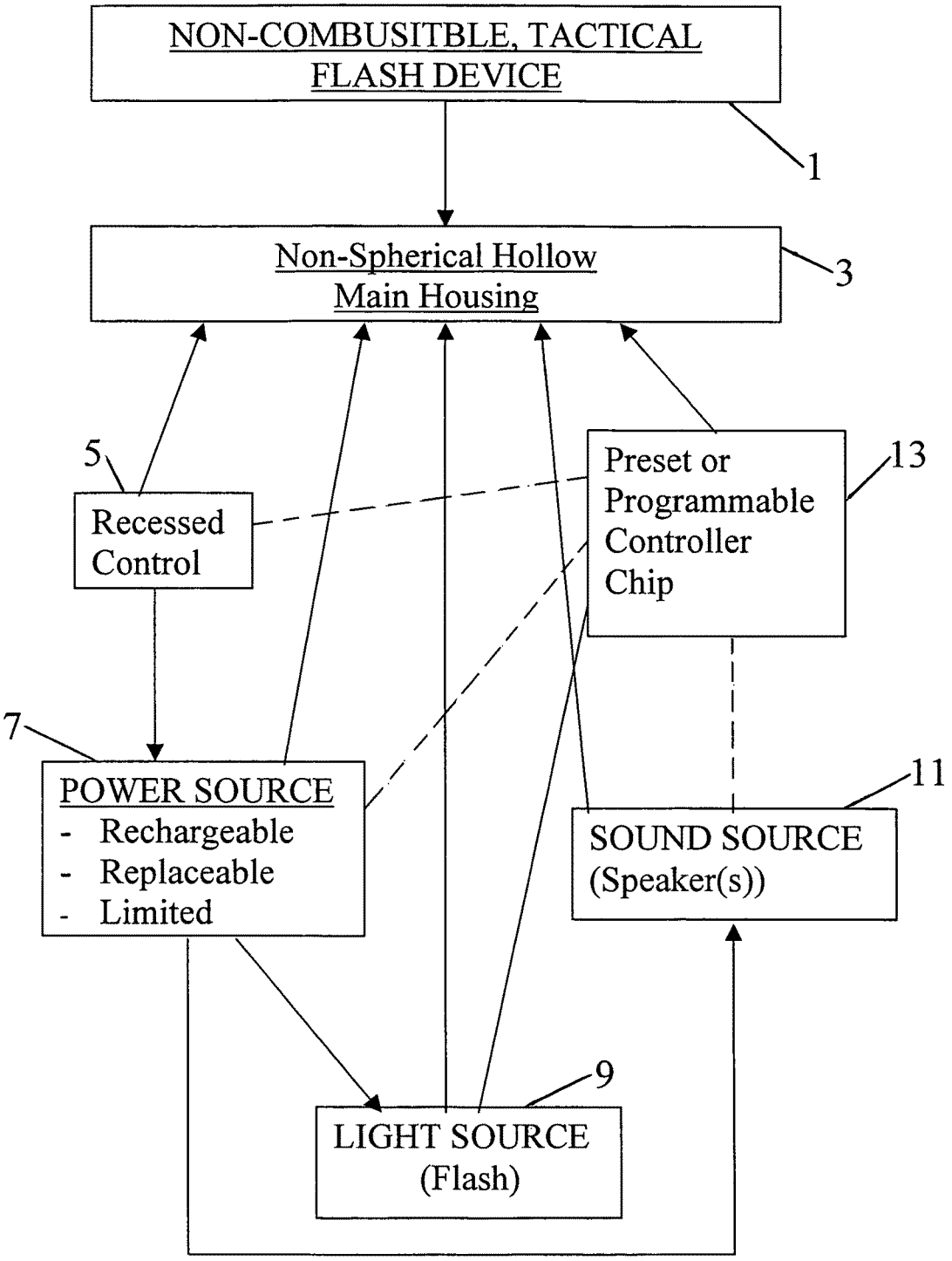
FIG. 1 is a diagrammatic representation of an overview of the present invention non-combustible, tactical flash device.

Referring now in detail to the drawings wherein like reference numerals designate corresponding parts throughout the several views, various embodiments of the present invention are shown.

In some embodiments of the present invention, the device may have a regular, symmetric shape or an irregular shape. For example, it could take the shape of an elongated angularly truncated cube (irregular shape) or a perfect cube or geodesic sphere (symmetrical shapes). In some preferred embodiments, the rectilinear shaped devices, e.g., elongated cubes and perfect cubes, would have truncated corners to enhance ergonomics. Generally, the overall cross section should be small enough to be grasped by an adult hand and would likely not exceed four inches and preferably not exceed three and a half inches. The main external feature, that is, the external aspects of the hollow main housing's physical structure may be solid, composite or lattice and may be formed of plastics, metals, natural materials, graphite fiber, similar materials or combinations thereof.

The present invention devices may have openings or windows, or protected transparent or translucent ports for collective or independent passage of light and sound. The internal features include all the components mentioned above in the Summary, and may include plural speakers and/or plural lights. The sound(s) and the light(s) may emit from the same or different areas, or both. For example, a present invention device internals may rest include a nominal base, a central frame onto which items are attached outwardly therefrom, or an exoskeleton frame within which items are attached, and may include separate speakers and separate lights in any of predetermined arrays. For example, speakers could be set up in a symmetrical six piece arrangement with speakers biometrically opposed so that speakers face up, down, left, right, back and front. Alternatively, three speakers could be in a single plane at 90° from one another so that they face left, up and right. Similarly, light forces could be arranged adjacent, inside or separate from the speakers. In one highly preferred embodiment, the main structure is created in halves and may be connected by any connecting means, such as hinge and lock, spring lock, threading, lateral latch, etc.

The present invention device may be used in place of conventional flash-bang devices that are used by police, SWAT, military, etc. These prior art devices rely upon actual explosion of explosive materials to create the bang (noise) and the flash (light), but pose a serious risk of ear, eye or other bodily injury to possible perpetrators or innocent parties in their vicinity. Thus, the present invention devices create both the bang or other noise and the flash of light, but do so without the use of dangerous explosives. Not only are the present invention devices useful for flash-bang applications, but also they are diverse multifunctional devices that have many applications not appropriate for conventional flash-bangs. For example, search and rescue missions or other activities may involve deployment of the present invention devices as markers or beacons to establish borders, points of interest, lines of movement, etc. Alternatively, officers or others on foot or in vehicles in pursuit of a victim or perpetrator or escapee or other person may quickly deploy and drop present invention devices to mark areas where there is evidence or other items of interest, e.g., when a fleeing drug dealer may toss evidence, the pursuer may now mark where the evidence has been tossed and continue the pursuit wherein subsequently the pursuer or other personnel may see flashing light and go back and retrieve the otherwise difficult to locate tossed evidence. In some embodiments of the present invention device, a signaling device such as a radio transmitter or RF tag may be included in the device for electronic location thereof.

FIG. 1 is a diagrammatic representation of an overview of the present invention non-combustible, tactical flash device 1. The non-spherical hollow main housing 3 has a plurality of flat surfaces to inhibit rolling when deployed. It has an externally exposed control 5, a button or other device (e.g., touch pad) that is recessed so as to not be impressed upon impact of the device, but so as to be accessible to a user to activate (start) the device. The control 5 turns on the functional system by, for example, providing power from power source 7, located inside main housing 3, to the light source 9 and the sound source 11. In preferred embodiments, the light and sound are delayed by a predetermined or programmed elapsed time, e.g., three seconds, and this is preferably accomplished by controller chip 13. As mentioned, the controller chip may be preprogrammed for various options wherein the light and sound or only one of these may be altered or shut down.

Figure 2:
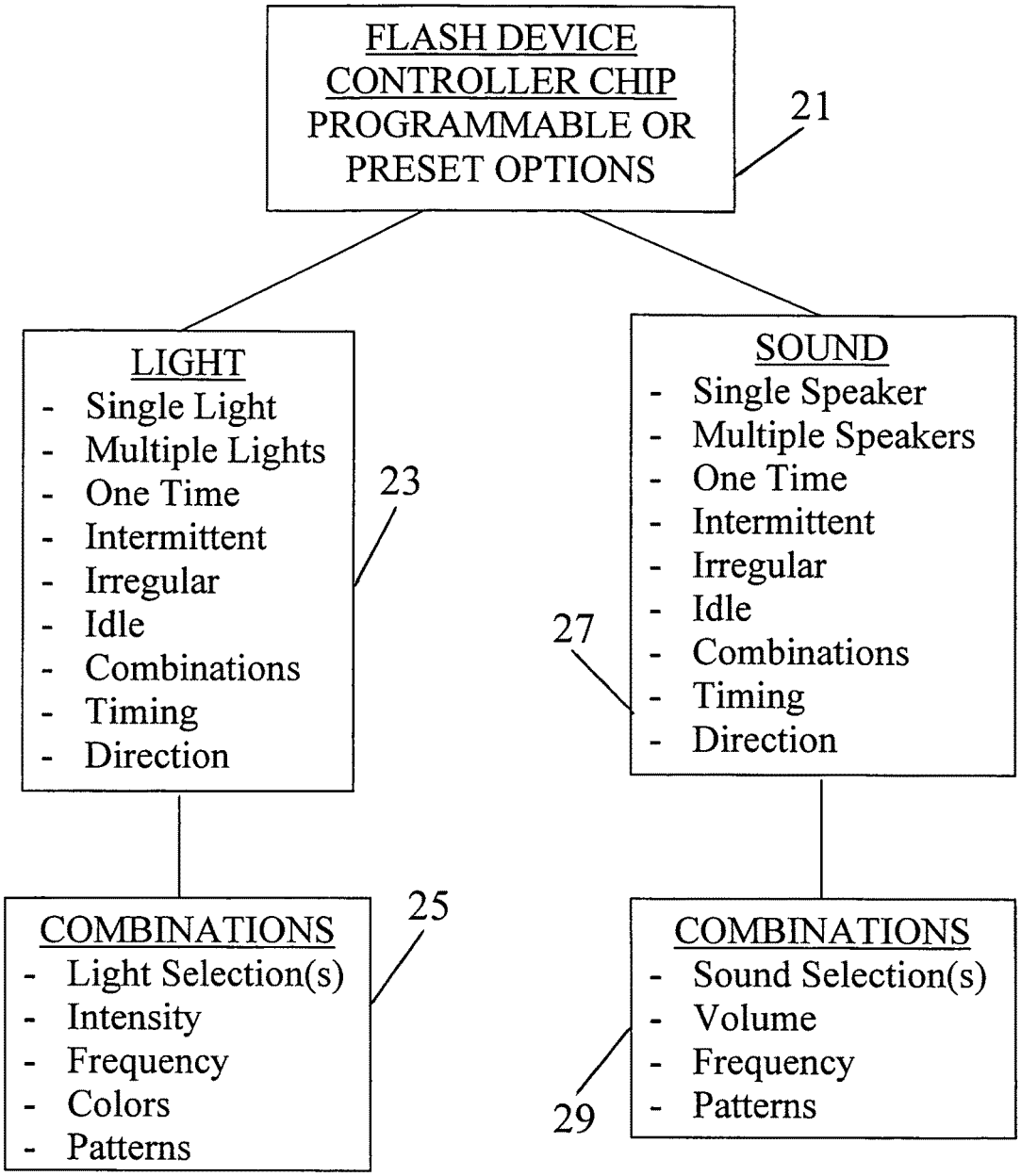
FIG. 2 is a diagrammatic representation of some preferred options for the present invention non-combustible, tactical flash device controller chip.

FIG. 2 is a diagrammatic representation of some preferred options for the present invention non-combustible, tactical flash device controller chip 21. The preset and/or programmable light options 23 include single light, multiple lights, one time light, intermittent light, irregular light patterns, idle (off), combinations of these and timing and direction options. Thus, present invention devices may be configured to accommodate any one or combination of the foregoing options for lights. The light combination parameters are shown in box 25 and these could be in the for of preset (unchangeable once set) or programmed (changeable), and include choice of lights (all, some, one or none) intensities, frequencies, colors and patterns. The preset and/or programmable sound options 27 include single speaker, multiple speakers, one time sound, intermittent sound, irregular sounds, idle (off), combinations of these and timing and direction options. Thus, present invention devices may be configured to accommodate any one or combination of the foregoing options for sound. The sound combination parameters are shown in box 29 and these could be in the for of preset (unchangeable once set) or programmed (changeable), and include choice of sounds (all, some, one or none), volumes, frequencies and patterns.

Figure 3:
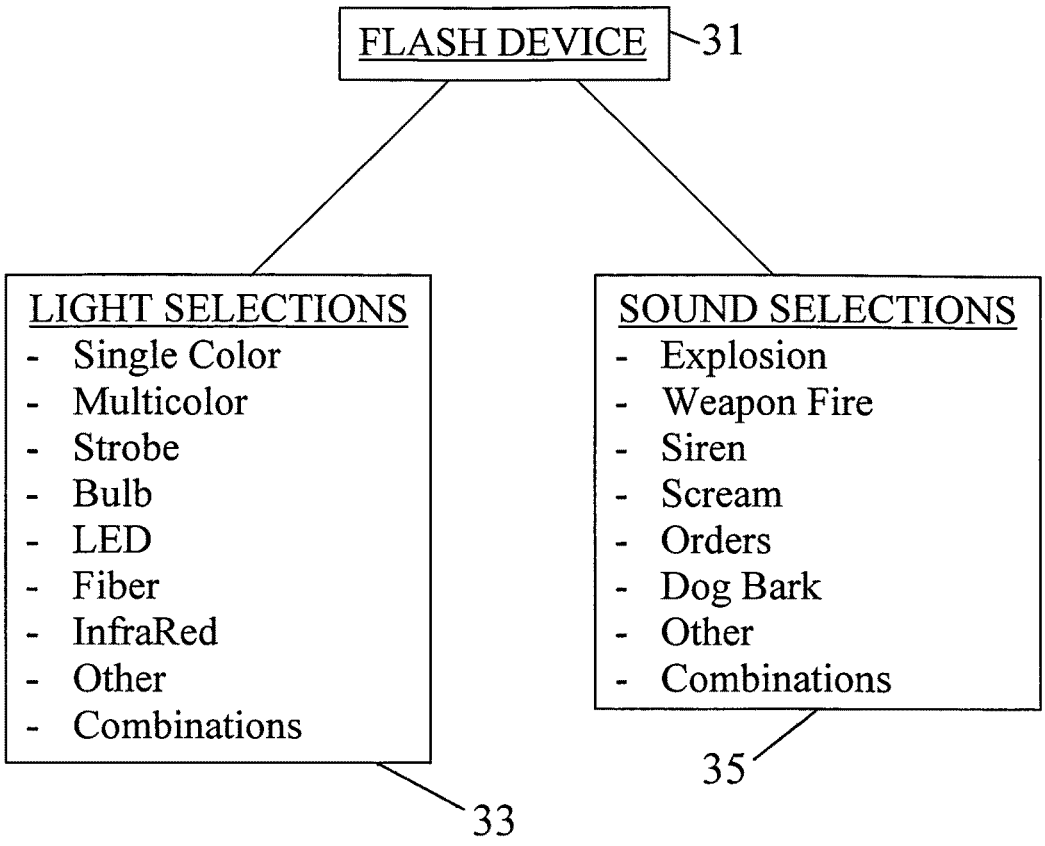
FIG. 3 is a diagrammatic representation of the present invention non-combustible, tactical flash device preferred light selections and preferred sound selections.

FIG. 3 is a diagrammatic representation of the present invention non-combustible, tactical flash device 31, showing preferred light selections 33 and preferred sound selections 35. Although any light or sound feature may be employed in the present invention devices, FIG. 3 illustrates some preferred possibilities: for lights-single or multiple colors, strobe, bulb, LED, fiber, infrared, others, such as camera flash cube, as well as combinations; for sound, explosion, weapon discharge, siren, orders, dog bark, others, such as crying child, woman pleading, or any other dialogue, as well as combinations thereof.

Figure 4:
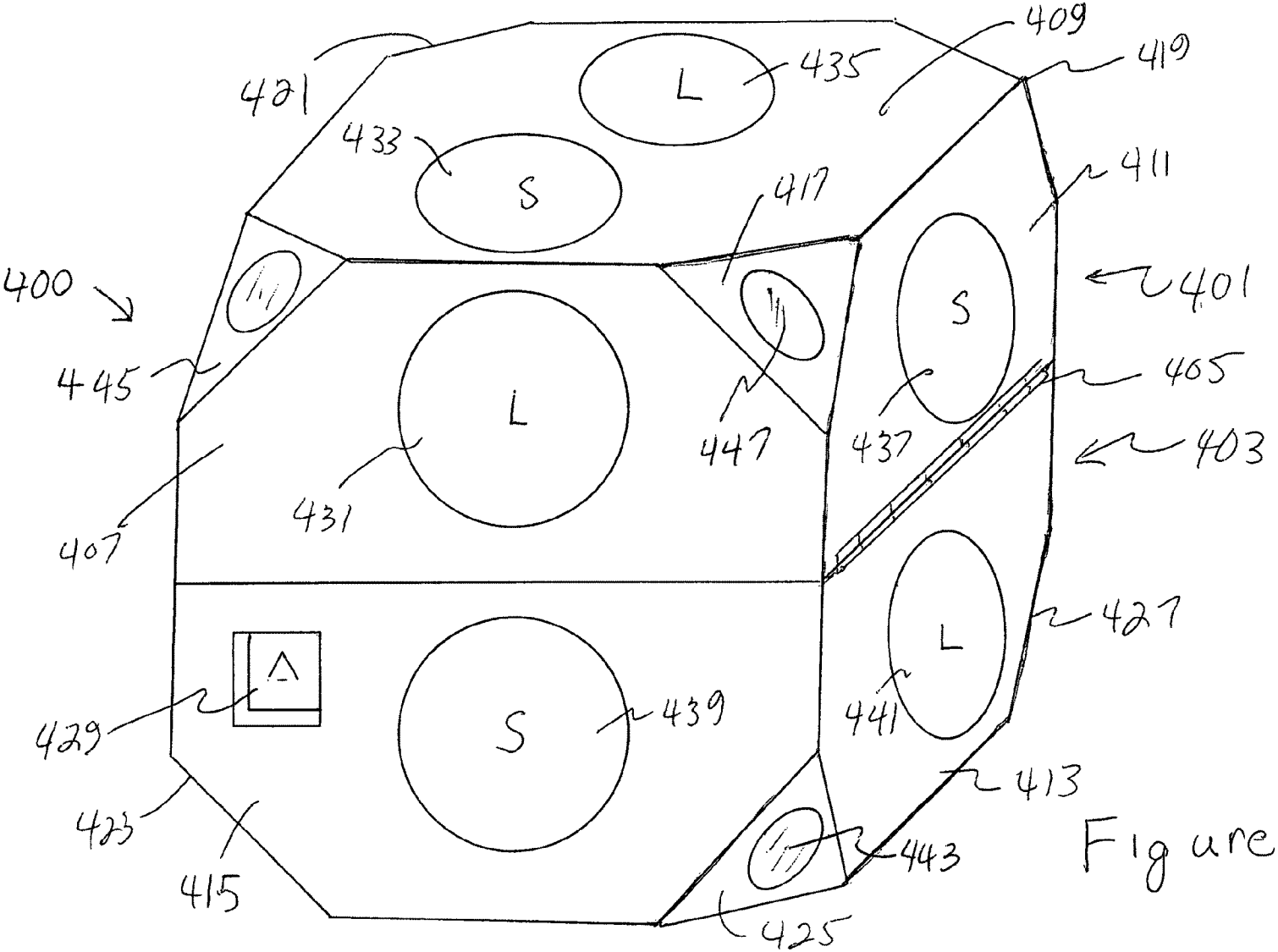
FIG. 4 is a perspective front view of a preferred embodiment of a present invention non-combustible, tactical flash device.

FIG. 4 is a perspective front view of a preferred embodiment of a present invention non-combustible, tactical flash device 400, it has a non-spherical hollow main housing that is in the shape of a corner truncated cube (hence, a 14 sided polygon) that has two halves that are connected to one another. Thus, upper half 401 is connected to lower half 403, and the connection could be snap lock, hinge and latch, force fit interconnection 405 or any other way to permanently or removeably attach the two halves together.

Device upper half 401 has an upper front 407, top 409, upper right side 411, upper left side (not shown) and upper back (not shown). Upper half 401 also has four truncated corners 419, 421, 445 and 417. These cut off corners and the ones on the lower half 403 provide a more ergonomic shape and make it easier for a user to hold the device 400 and to throw it. Additionally, these corners, as well as all flat surfaces, may reduce roll and thereby enhance accuracy in deployment. Device lower half 403 has a lower front 415, lower right side 413, bottom (not shown), upper left side (not shown) and upper back (not shown). Lower half 403 also has four truncated corners, including corners 423, 425 and 427. The corners may optionally have light ports, sound ports or both, such as corners 417 and 425 with light ports 447 and 443, respectively. Light ports are protected transparent or translucent areas (such as clear high impact plastic) that act like windows for light and may have actual light sources behind them or may release light from nearby light sources not directly positioned at the port.

The main facets (front, back, top, bottom, sides) may have one or more light ports and may have one or more sound ports (a sound port is a protected or unprotected opening for a speaker or for release of sound from an internal nearby speaker). These facets may alternatively be solid or have orifices with no functional features. Thus, upper front 407 has a light port (L) 431; top 409 has a sound port (S) 433 and a light port (L) 435; and upper right side 411 has a sound port (S) 437. Also, lower front 415 has a sound port (S) 439; top 409 has a sound port (S) 433 and a light port (L) 435; and lower right side 413 has a light port (L) 441.

Every present invention device includes an activation mechanism to initiate the sound and/or light. There is typically a three or four second delay from activation to discharge and the starter may be a signal, but is typically a touch or press button. In the FIG. 4 present invention device 400, the activation mechanism is recessed push button 429, located on lower front 415. It is recessed to reduce the likelihood of accidental firing and to prevent reactivation after deployment (when it lands).

Figure 5:
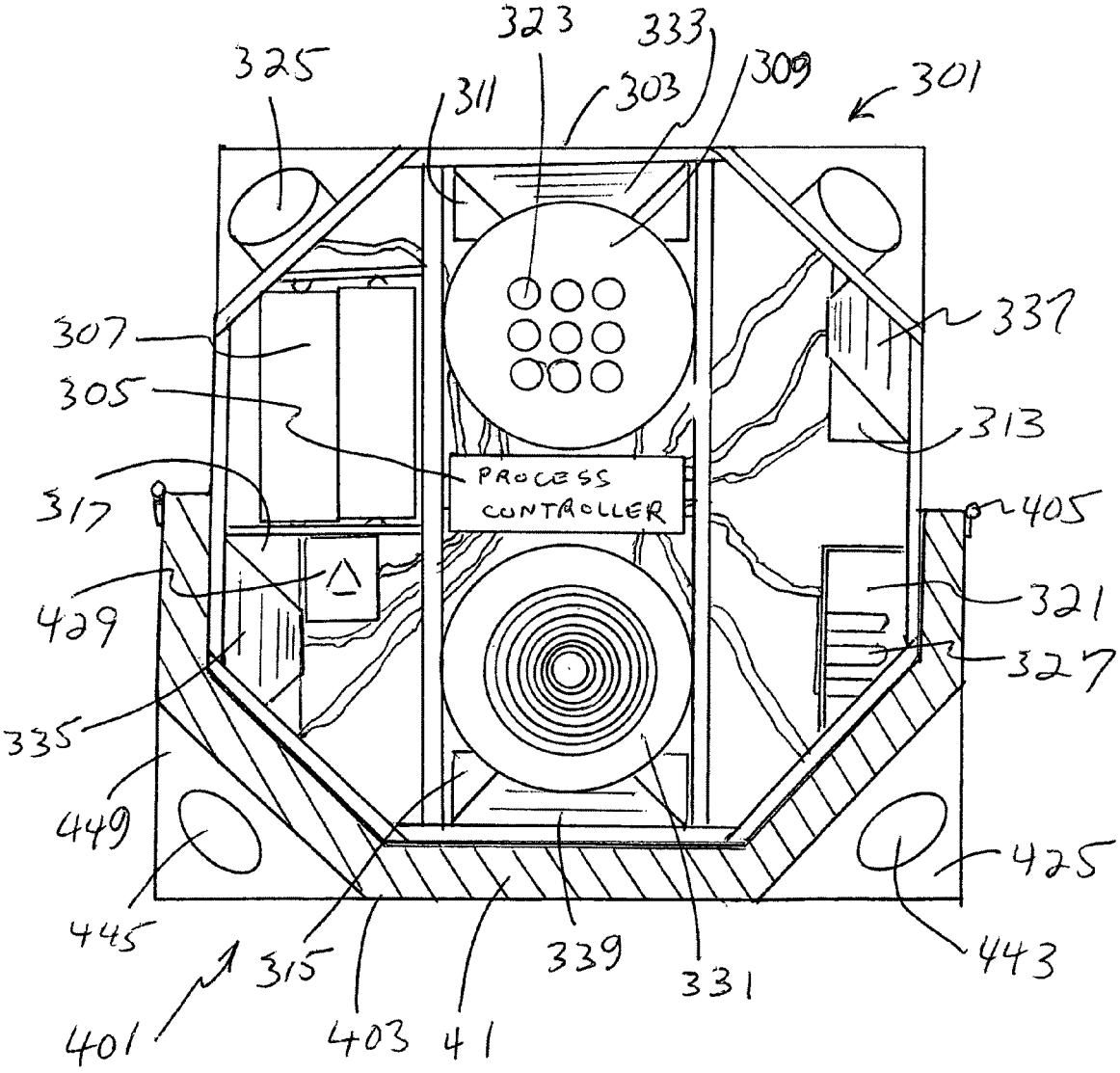
FIG. 5 is a partial cut front view of the present invention non-combustible, tactical flash device shown in FIG. 4.

FIG. 5 is a partial cut front view of the present invention non-combustible, tactical flash device shown in FIG. 4 with its internal functional components exposed. The aspects of FIG. 5 that have been shown in FIG. 4 are identically numbered and hence not restated here. Note that main housing lower half 401 is cut for exposure and that upper half 403 has been moved from this rendition. There is an internal main frame 301 that fits tightly into the main housing. Main frame 301 may be formed of heavy duty plastic or metal and formed of bar or tube stock such as bar 303. Main frame 301 contains and holds the process controller 305, the power source 307, port aligned light arrays 321, 323, 325, and others (not shown), as well as port aligned speakers 331, 333, 335 and 337. It also supports the optional corner lights, such as light 325. It has of all necessary wiring and/or board circuitry to connect all of these components to the controller and power source, and to connect the activation button 429 to the process controller 305. Because this embodiment is preprogrammed, a user merely presses button 429 to start the delayed "firing" of the preset sounds and lights. For example, a SWAT member may have a hostage situation where a distraction to the perpetrator is needed. The member will press button 429 and toss the device through a window or opening where the hostage is kept. Within seconds, the device "fires", causing a formidable distraction to the perp, giving the SWAT team a momentary advantage to act against the perp. In a different scenario, a trooper chasing a drug user or a robber in a vehicle can act quickly to deploy the present invention device by using it as a locator when evidence is thrown from a vehicle (or by a runner).

Figure 6:
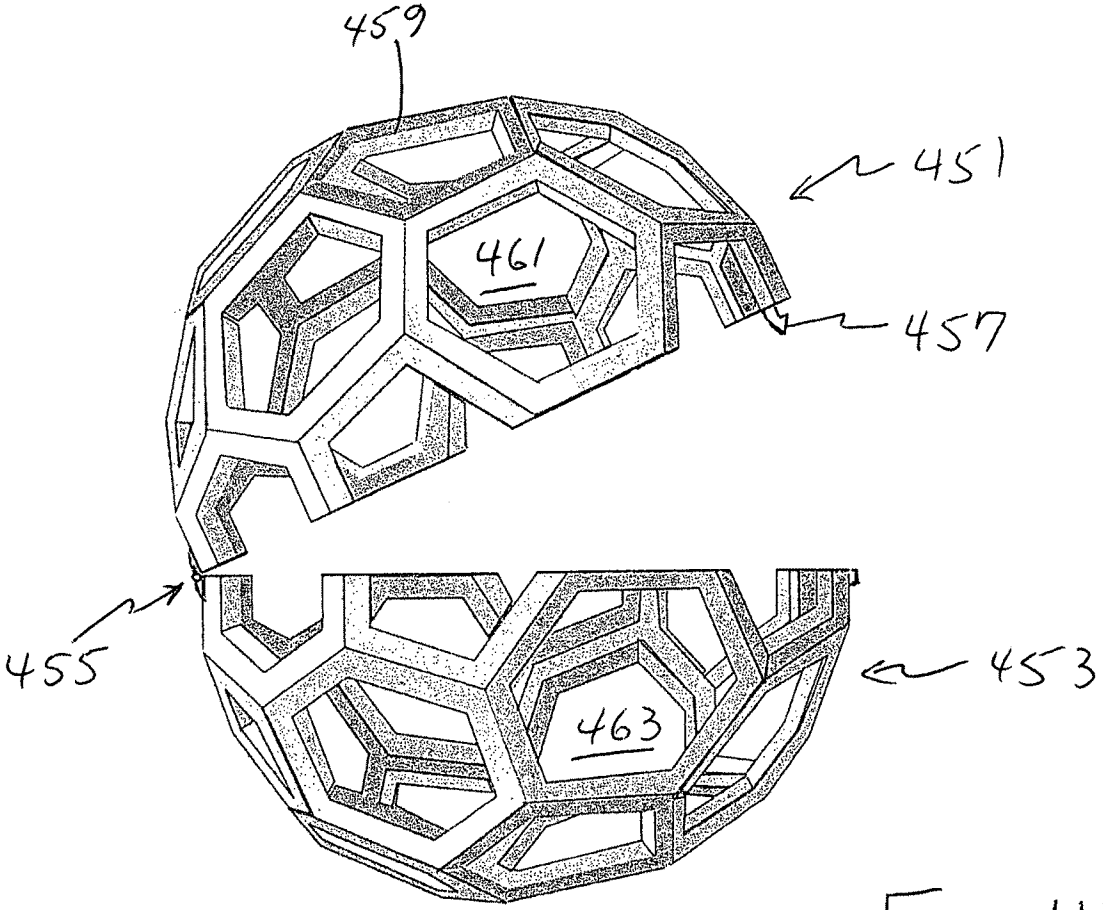
FIG. 6 is a front view of a preferred embodiment of a present invention non-combustible, tactical flash device main housing.

FIG. 6 is a front view of a preferred embodiment of a present invention non-combustible, tactical flash device main housing in the form of a DaVinci geodesic sphere. Because it is geodesic, it has flat facets, as shown. There is an upper half shell 451 and a lower half shell 453, each with pentagonal flat, interconnected cut outs, such as open pentagon 459. Also, each has hollow interior regions 461 and 463, respectively, for encompassing functional and supporting components. The two half shells 451 and 453 are hingedly connected via hinge 455 and are latched together after the internals have been installed, with snap latch 457. Various internal possibilities are available and FIGS. 8 and 9 below offer some preferred arrangements.

Figure 7:
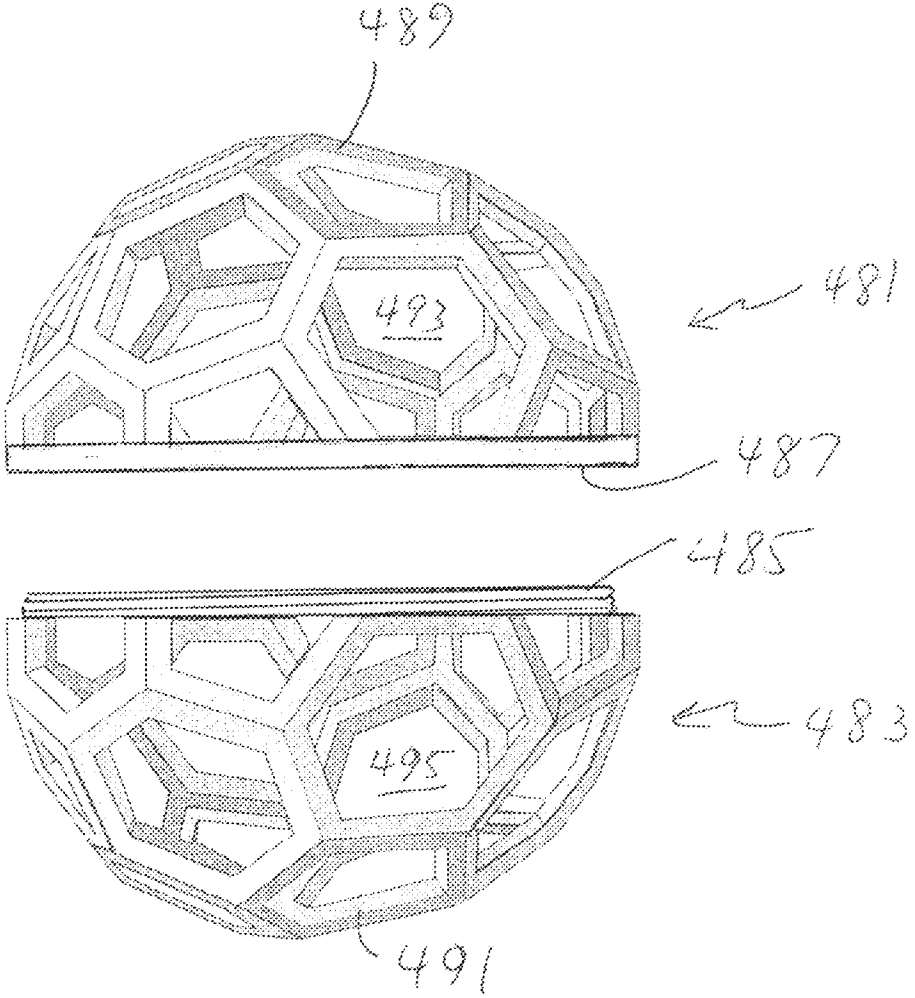
FIG. 7 is a front view of another preferred embodiment of a present invention non-combustible, tactical flash device main housing.

FIG. 7 is a front view of another preferred embodiment of a present invention non-combustible, tactical flash device main housing also in the form of a DaVinci geodesic sphere, similar to the one shown immediately above. Because it is geodesic, it has flat facets, as shown. There is an upper half shell 481 and a lower half shell 483, each with flat, pentagonal and hexagonal interconnected cut outs, such as open pentagon 489. Also, each has hollow interior regions 493 and 495, respectively, for encompassing functional and supporting components. The two half shells 481 and 483 are connected by being screwed together via external threads 485 and corresponding receiving (internal) threads (not shown) under lip 487, after the internals have been installed. Various internal possibilities are available and FIGS. 8 and 9 below offer some preferred arrangements.

Figure 8:
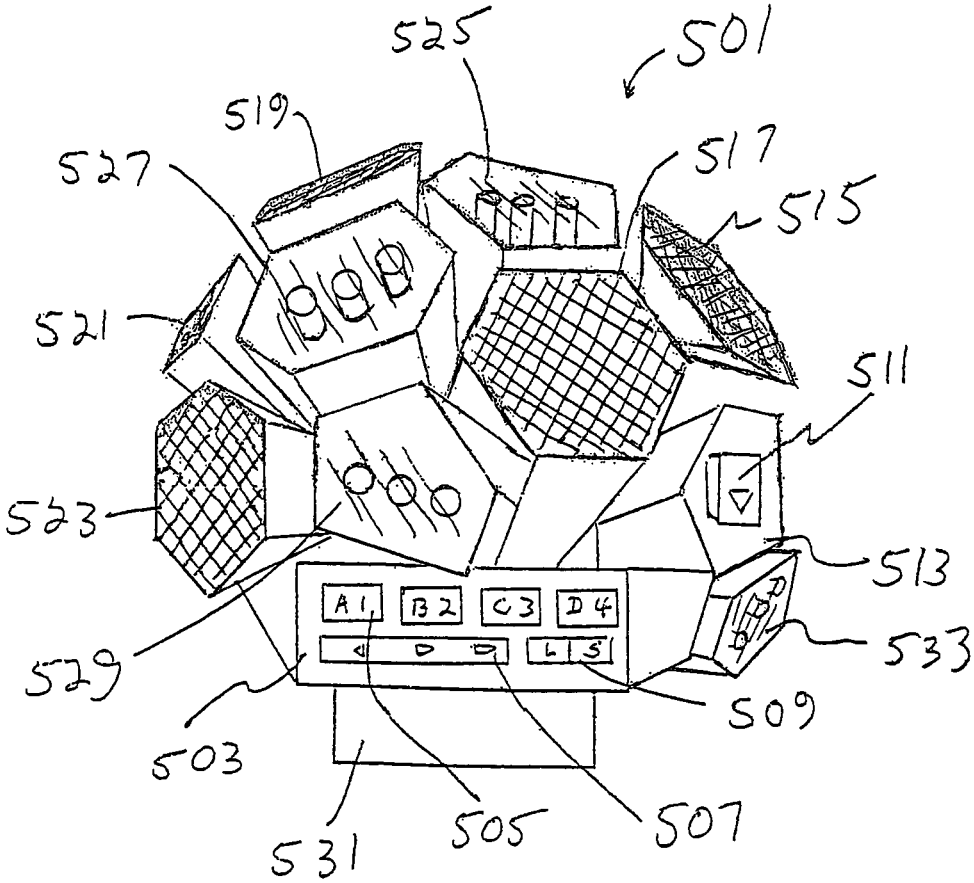
FIG. 8 is a front view of all of the internal features of a present invention device that may be inserted into a present invention device main housing, such as one of those shown in FIGS. 4, 6 and 7; and, FIG. 9 is a diagrammatic representation of a component arrangement for another present invention non-combustible, tactical flash device.

FIG. 8 is a front view of all of the internal features of a present invention device 501 that may be inserted into a present invention device main housing, such as one of those shown in FIGS. 4, 6 and 7. Unlike the internal components that are held in place by the exoskeleton framework shown in FIG. 5, in this embodiment, the internal components of the present invention device are held in place by a central core frame that is both the housing for the process controller and a component plug or snap in receiver for the speakers and lights. Thus, in FIG. 8, present invention device internal component array 501 a core housing 503 that has plug ins for speakers 515, 517, 519, 523 and possible other speakers or sound components, as well as plug ins for light bundles, such as bundles 521, 525, 527, 529 and 533.

Core housing 503 also includes a battery 531, or other power pack support structure and connections to the activation button 511 located on pod 513. Core housing 503 contains a transmitter 509 and the central processor that is programmable with input spots such as buttons or touch screens 505 and 507. These may be used to select sounds from a stored selection, to select light choices, to set sound volumes and sequences, to set light sequences, to set frequency, periodicity, duration and any other programmable parameter that a designer may desire.

Transmitter 509 may be turned on or off, as may be the lights and/or sound utilizing the aforesaid programmable features. The device may be set up as a flash bang device, an intermittent light beacon, a light and sound marker, a location transmitter or a combination of these. Once a user or administrator has set up the desired program for the transmitter and/or sound and/or light, the component array 501 is placed in and closed in a receiving main housing such as those shown in the FIGS. 6 and 7 above, ready for use. When the device is needed for deployment, the user just presses activation button 511 and tosses or places the device where needed.

Figure 9:
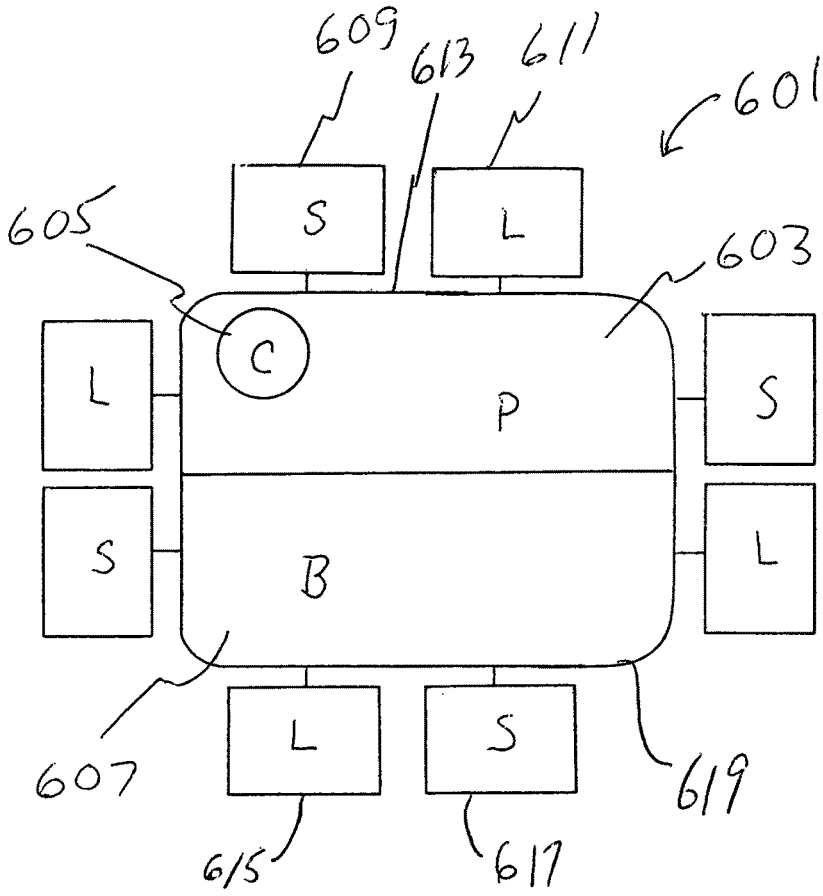

FIG. 9 shows a simple diagrammatic representation of another possible preferred component arrangement for another present invention non-combustible, tactical flash device. Arrangement 601 includes a central processor 603 with a control or activation button 605, and battery or other power pack 607. In this arrangement 601, lights and speakers are set in a single plane, with one of each on each of four sides, such as speaker 609 and light 611 on the top 613, and such as light 615 and speaker 617 on bottom 619. If this arrangement were set inside a main housing such as the one shown in FIG. 4, no matter what facet the device landed on, at least three of the four sets of speakers and lights would be exposed (not facing a floor) for effective "firing".

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A non-combustible, tactical flash device, which comprises:

a) a non-spherical hollow main housing consisting of truncated corners and flat surfaces on top and side portions thereof adapted to reduce roll and enhance accuracy in deployment, said main housing having mounting means for internal functional components; and, b) internal functional components connected to said mounting means of said main housing, including:

i. an externally exposed activation component located on said main housing;

ii. a power source located within said main housing and being connected to said activation component and to a control chip;

iii. said control chip located within said main housing and being connected to said power source and connected to at least one speaker and at least one light source, said control chip including capabilities for delay of processing of other commands upon initiation of said activation component, and for subsequent processing of other commands including sound delivery to said at least one speaker and light activation to said at least one light source;

iv. said at least one speaker located within said main housing and being functionally connected to said control chip and having sound exposure external to said main housing; and, v. said at least one light source located within said main housing and being functionally connected to said control chip and having light exposure external to said main housing;

c) said tactile flash device being non-combustible, d) said internal functional components further include at least one beacon transmitter;

e) said control component is capable of being programmed to intermittently repeat at least one of sound delivery and light activation for predetermined time lengths and periodicities; and f) said main housing including component parts that permit opening for exposure to said internal functional components and subsequent secure closing thereof;

wherein said non-combustible, tactile flash device is appointed for deployment by tactile forces in order to create a diversion, said diversion being created by the production of sufficiently loud sounds by said speaker or the emission of sufficiently bright light by said light source, and said non-spherical shape of said main housing is capable of reducing run away rolling and enhancing accuracy during deployment.

2. The non-combustible, tactical flash device of claim 1 wherein said main housing and said internal functional components have a total weight in excess of one pound and less than six pounds.

3. The non-combustible, tactical flash device of claim 2 wherein said main housing and said internal functional components weight in excess of one and one-half pounds and less than four pounds.

4. The non-combustible, tactical flash device of claim 1 wherein said control chip is preprogrammed to deliver at least one sound selected from the group consisting of a detonation, a dog bark, an alarm, a siren, and a human voice.

5. The non-combustible, tactical flash device of claim 1 wherein said at least one light source in at least three different light sources having light beam generation in at least three different directions.

6. The non-combustible, tactical flash device of claim 1 wherein said at least one speaker is at least three different speakers having sound generation in at least three different directions.

7. The non-combustible, tactical flash device of claim 1 wherein said at least one light source is selected from the group consisting of lasers, LEDs, photovoltaics, flash bulbs, infrared and flashlight bulbs.

8. The non-combustible, tactical flash device of claim 1 wherein said main housing has a shape selected from the group consisting of a cube, rectangle, polygon and geodesic sphere.

9. A non-combustible, tactical flash device, which comprises:

a) a non-spherical hollow main housing consisting of truncated corners and flat surfaces on top and side portions thereof adapted to reduce roll and enhance accuracy in deployment, said main housing having mounting means for internal functional components; and, b) internal functional components connected to said mounting means of said main housing, including:

i. an externally exposed activation component located on said main housing;

ii. a power source located within said main housing and being connected to said activation component and to a control chip;

iii. said control chip located within said main housing and being connected to said power source and connected to at least one speaker and at least one light source, said control chip including capabilities for delay of processing of other commands upon initiation of said activation component, and for subsequent processing of other commands including sound delivery to said at least one speaker and light activation to said at least one light source;

iv. said at least one speaker located within said main housing and being functionally connected to said control chip and having sound exposure external to said main housing; and, v. said at least one light source located within said main housing and being functionally connected to said control chip and having light exposure external to said main housing;

c) programmable control means located at least one of externally from and internally with said main housing, said programmable control means including means for selecting at least one device characteristic selected from the group consisting of sound choices, light choices and periodicity choices;

d) said tactile flash device being non-combustible, e) said internal functional components further include at least one beacon transmitter;

f) said control component is capable of being programmed to intermittently repeat at least one of sound delivery and light activation for predetermined time lengths and periodicities; and g) said main housing including component parts that permit opening for exposure to said internal functional components and subsequent secure closing thereof; wherein said non-combustible, tactile flash device is appointed for deployment by tactile forces in order to create a diversion, said diversion being created by the production of sufficiently loud sounds by said speaker or the emission of sufficiently bright light by said light source and said non-spherical shape of said main housing is capable of reducing run away rolling and enhancing accuracy during deployment.

10. The non-combustible, tactical flash device of claim 9 wherein said main housing and said internal functional components have a total weight in excess of one pound and less than six pounds.

11. The non-combustible, tactical flash device of claim 10 wherein said main housing and said internal functional components weight in excess of one and one-half pounds and less than four pounds.

12. The non-combustible, tactical flash device of claim 9 wherein said control chip is preprogrammed to deliver at least one sound selected from the group consisting of a detonation, a dog bark, an alarm, a siren, and a human voice.

13. The non-combustible, tactical flash device of claim 9 wherein said at least one light source in at least three different light sources having light beam generation in at least three different directions.

14. The non-combustible, tactical flash device of claim 9 wherein said at least one speaker in at least three different speakers having sound generation in at least three different directions.

15. The non-combustible, tactical flash device of claim 9 wherein said at least one light source is selected from the group consisting of lasers, LEDs, photovoltaics, flash bulbs, infrared and flashlight bulbs.

* * * * *